United States Patent [19]

Branson

[11] Patent Number: 4,927,271

[45] Date of Patent: May 22, 1990

[54] RECLOSEABLE TAMPER EVIDENT BAG WITH HOODED CLOSURE

[75] Inventor: Mark E. Branson, Shelbyville, Ind.

[73] Assignee: KCL Corporation, Shelbyville, Ind.

[21] Appl. No.: 282,615

[22] Filed: Dec. 12, 1988

[51] Int. Cl.[5] ..... B65D 33/34

[52] U.S. Cl. ..... 383/5; 383/61; 383/63; 383/78; 206/610

[58] Field of Search ..... 383/5, 61, 63, 65, 78; 206/610

[56] References Cited

U.S. PATENT DOCUMENTS

| | | | |
|---|---|---|---|
| 3,181,583 | 5/1965 | Lingenfelter | 383/63 X |
| 3,226,787 | 1/1966 | Ausnit | 383/61 X |
| 3,619,395 | 11/1971 | Skendzic | 383/61 X |
| 3,780,781 | 12/1973 | Uramoto | 383/65 X |
| 3,808,649 | 5/1974 | Ausnit | 383/63 X |
| 3,827,472 | 8/1974 | Uramoto | 383/61 X |
| 4,337,889 | 7/1982 | Moertel | 383/61 |
| 4,589,145 | 5/1986 | Van Erden et al. | 383/5 |
| 4,682,366 | 7/1987 | Ausnit et al. | 383/35 X |

FOREIGN PATENT DOCUMENTS

| | | | |
|---|---|---|---|
| 276554 | 8/1988 | European Pat. Off. | 383/78 |
| 893339 | 6/1944 | France | 383/78 |
| 1536784 | 12/1978 | United Kingdom | 383/78 |
| 2051003 | 1/1981 | United Kingdom | 383/5 |

*Primary Examiner*—Stephen Marcus
*Assistant Examiner*—Jes F. Pascua
*Attorney, Agent, or Firm*—Woodard, Emhardt, Naughton, Moriarty & McNett

[57] ABSTRACT

A tamper evident recloseable bag is disclosed having two opposing wall panels, a recloseable fastener profile assembly extending across the upper portion of the wall panels and a hooded closure enveloping the entire upper portion of the wall panels. The hooded closure arrangement seals the bags closed until intentional opening of the bag is desired, at which time the hooded closure can be removed by lightly pulling it in an upwardly direction. The removed hooded closure visually indicates the opened condition of the bag.

16 Claims, 4 Drawing Sheets

RECLOSEABLE TAMPER EVIDENT BAG WITH HOODED CLOSURE

BACKGROUND OF THE INVENTION

This invention relates generally to tamper evident recloseable bags of the type typically fabricated from plastic film and having two opposing bag walls, and is particularly concerned with a novel hooded closure structure for said bags.

Several methods of construction for tamper evident bags are known in the art. These methods include sealed bag walls above the fastener profile assembly and the use of fastener profile assemblies or other closeable arrangements which are of a permanent type. These methods have several disadvantages which the present invention solves. A common problem associated with tamper evident bags having a sealed top edge above a fastener profile assembly is the difficult opening process. Because the upper portion of bag walls are normally constructed for durability and rigidity to make opening of the fastener assembly easier, this portion has a heavy wall thickness. The heavy wall thickness is not conductive to tearing, for access to the fastener assembly. Even where the walls are perforated as in U.S. Pat. Nos. 3,827,472 and 3,266,787, tearing of the upper portion is still laborsome because the walls must still be thick enough to have fastener profiles sealed thereon.

Other methods have been tried in connection with a sealed top edge such as having a tear strip behind or extruded in the upper portion of a bag wall. Opening is achieved by pulling the tear strip from one end of the bag to the other thereby ripping the tear strip through the bag wall. The same problem of having durable rigid upper wall portions still exists, which makes pulling the tear strip difficult. Even where the area in front of the tear strip is of a lighter construction, as in U.S. Pat. No. 3,619,395, there is a problem of having a jagged top edge once the tear strip is ripped through the bag wall. In addition, bags having sealed top ends must be filled through the bottoms, which are sometimes more difficult to handle.

SUMMARY OF THE INVENTION

It is an object of the present invention to provide a tamper evident bag which, when opened, will indicate the bag has been tampered with.

It is a further object of the present invention to provide a tamper evident bag which is recloseable after opening.

It is a further object of the present invention to provide a tamper evident bag which can be opened in an expedient and clean fashion.

It is still a further object of the invention to attain such a desirable construction in an economical and efficient manner.

To this end, the present invention provides for a tamper evident bag having two opposing wall panels, a recloseable fastener profile assembly extending across the upper portion of said wall panels and a hooded closure enveloping the entire upper portion of said wall panels. The hooded closure comprises a thin walled plastic film formed in a C-shape over the outer edges of the top portion of the bag walls thereby enveloping the entire openable top area of the bag and restricting access to the recloseable fastener profile assembly underneath. The hooded closure has perforated tear lines for removal of the top portion of the hood. Access to the bag is gained by tearing along the lines of perforation so as to remove the hooded closure and then pulling apart the side walls of the bag, thereby disengaging the fastener profile assembly. The removed hooded closure visually indicates the opened condition of the bag.

Other objects, features and advantages of the present invention will be readily apparent from the following description of a representative embodiment thereof, taken in conjunction with the accompanying drawings, although variations and modifications may be effected without departing from the spirit and scope of the novel concepts embodied in the disclosure.

DESCRIPTION OF THE PREFERRED EMBODIMENT

Figure 1:
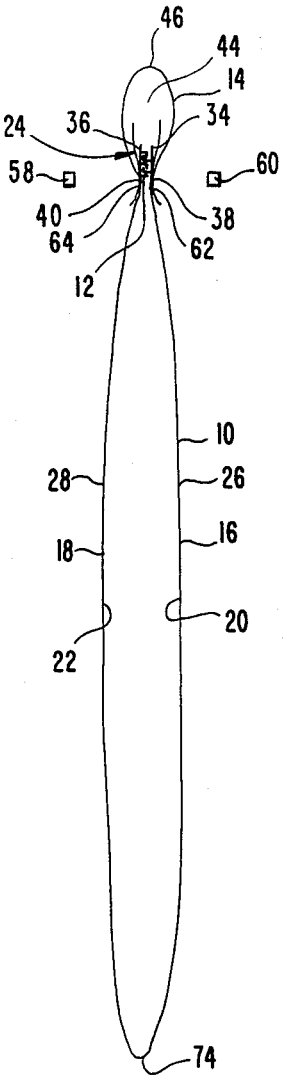
FIG. 1 is a vertical sectional view of a tamper evident bag, showing the recloseable fastener assembly and hooded closure embodying the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
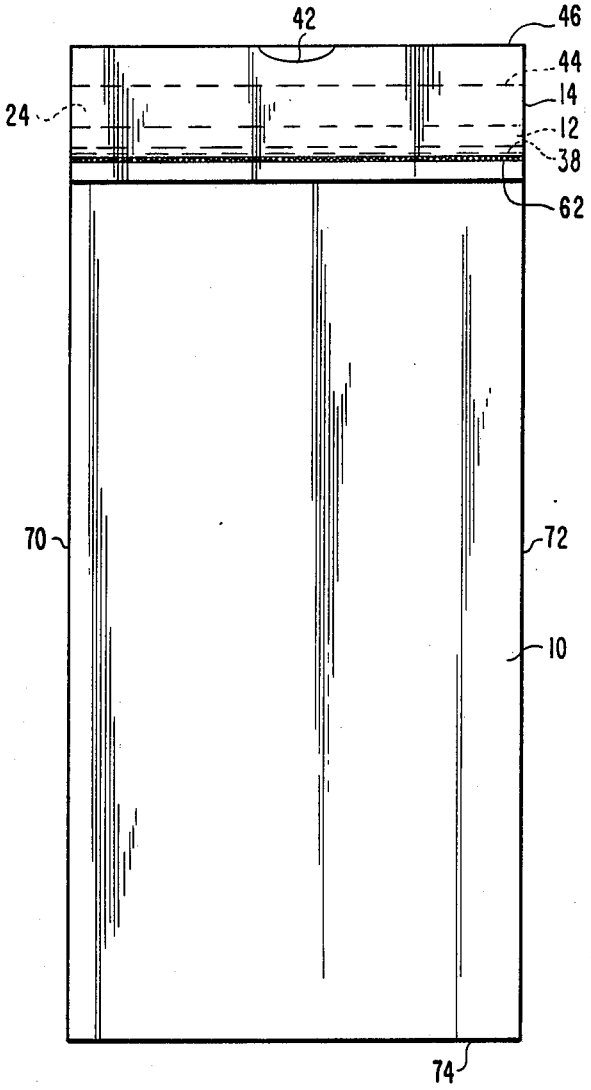
FIG. 2 is a front elevational view of the tamper evident bag embodying the present invention.

A tamper evident bag 10 is provided comprising a fastener profile assembly 12 and a hooded closure 14 which are illustrated in FIGS. 1 and 2. The bag 10 is constructed of a suitable plastic film and has opposing wall panels 16 and 18 with inside surfaces 20 and 22 facing toward each other. A recloseable fastener profile assembly 12 is adapted to be attached to the inside surfaces 20 and 22 of the top portion 24 of the wall panels 16 and 18 respectively, and a hooded closure 14 is adapted to be attached to the outside surfaces 26 and 28 of the top portion 24 of the wall panels 16 and 18.

The hooded closure 14 completely seals the bag 10 by limiting access to the openable and recloseable fastener profile assembly 12 which is located under the hooded closure.

Figure 3:
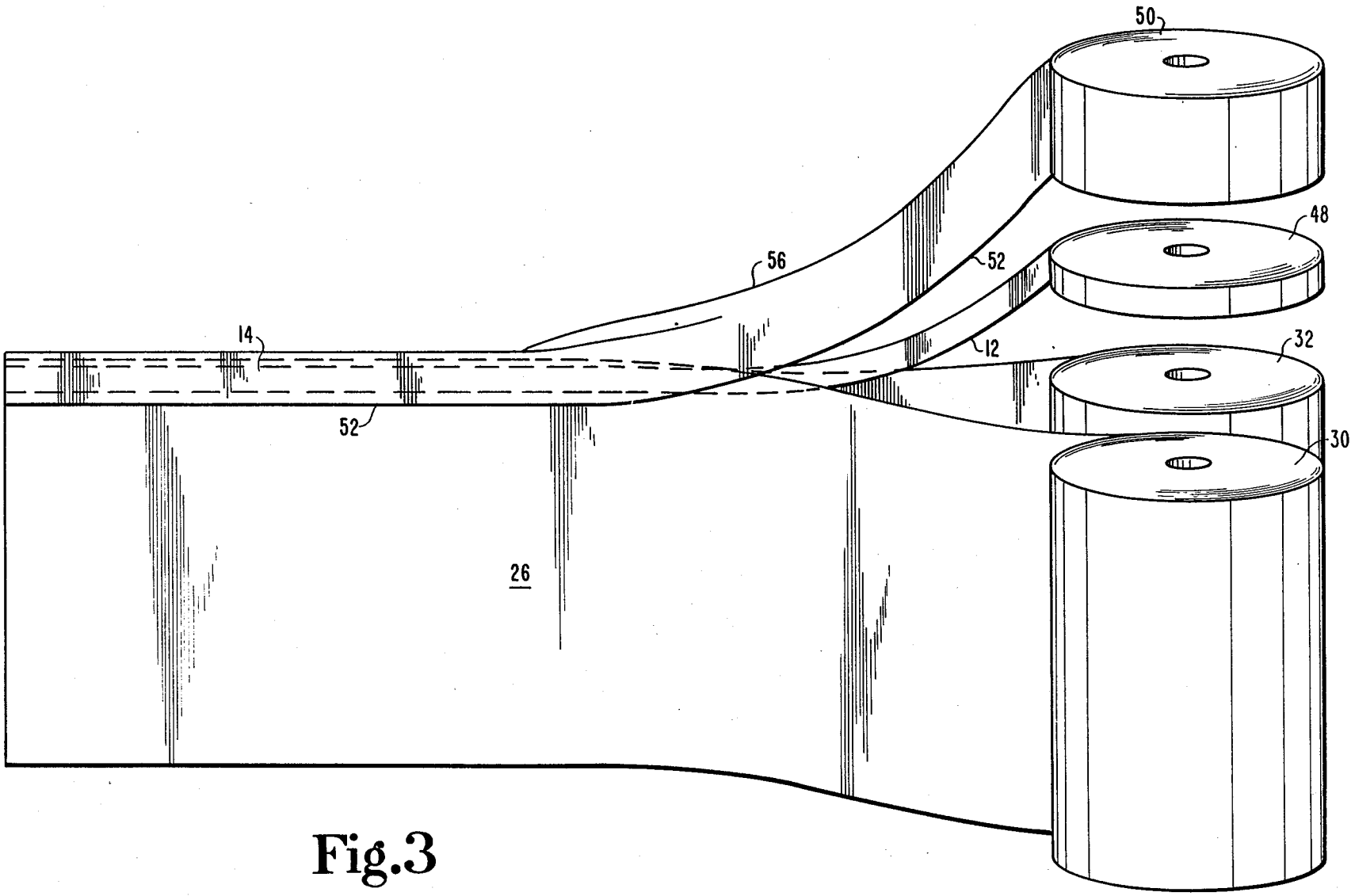
FIG. 3 is a schematic illustration of the steps in the method of making the recloseable bags.

The plastic film is preferably arranged in rolls as illustrated in FIG. 3 where two continuous webs 30 and 32 of film can be advanced from the rolls in a flattened position oppositely disposed to each other, and which will be formed into wall panels 16 and 18 respectively.

Although the above described arrangement is preferred for this application, the bag wall panels 16 and 18 may also be constructed of a circumferentially continuous cylindrically shaped tube of plastic film which is flattened to form side wall panels, or may also be constructed of a pair of individual webs of plastic film.

FIG. 1 illustrates a bag 10 provided with means for selectively opening and closing the bag 10 for repeated use. To that end a recloseable fastener profile assembly 12 is provided including first 34 and second 36 cooperating fastener profile elements formed respectively on the inner sides 20 and 22 of the wall panels 16 and 18.

The fastener profile elements 34 and 36 are oppositely disposed in face to face relation in the assembled condition of the bag 10 and extend lengthwise across the upper portion of the bag 10 and positioned for proper alignment to insure easy closure. The specific configuration of the interlocking fastener profile elements 34 and 36 is exemplary of many configurations well known in the art which are selectively closeable by applying light pressure from behind each fastener profile element in a transverse direction toward each other. The fastener profile assembly 12 may be opened by pulling the wall panels 16 and 18 apart, thereby disengaging the fastener profile elements 34 and 36 along the length of the bag 10.

It is a desirable characteristic of the invention to enable the user of the bag to gain access thereto easily, without diminishing the deterrent effect to opening the completely sealed bag 10 by unintended users. To this end, a hooded closure 14 is attached in a C-shaped fashion to the outer sides 26 and 28 of each wall panel 16 and 18 proximate to the upper portion 24, thereby enveloping and completely convering the entire upper portion 24 of the bag 10.

A perforated line 38 and 40 is formed on each side of the hooded closure 14 and extends across the entire length of the hooded closure 14. The thickness (relative thinness) of the hooded closure 14 in combination with the lines of perforation 38 and 40 allows for the easy removal of said hooded closure 14 in an expedient manner. As a result of this configuration, the hooded closure 14 also pulls away cleanly from the lines of perforation 38 and 40, leaving no jagged or sharp edges along the top of the bag.

To remove the hooded closure 14, thereby allowing access to the openable fastener profile assembly 12 located underneath, the center 42 of the hooded closure 14 is grasped by the user and pulled in an upward direction away form the lines of perforation 38 and 40 until the upper portion of hooded closure 14 becomes completely detached from the bag 10. The hooded closure 14 may be visually marked such a shown at center 42 to indicate the preferred grasping location. With the upper portion of the hooded closure 14 removed, full access to the recloseable fastener profile assembly 12 and therewith, access to the contents of the bag 10, is provided. In order to enable the user to more readily determine whether the bag 10 has been opened, the plastic from which the hooded closure 14 is formed may be colored differently from that which the wall panels 16 and 18 are formed. In that the hooded closure 14 is located at the upper portion 24 of the bag 10, a colored hooded closure 14, no matter how opaque it may be, will not interfere with the ability to see the contents of the bag where the wall panels 16 and 18 are transparent or translucent.

As illustrated in FIG. 1, the top edge 44 of the fastener profile elements 34 and 36 is located an appropriate distance below the top edge 46 of the hooded closure 14, thereby providing an area therebetween which facilitates easy grasping of said hooded closure 14 during removal maneuver. Therefore, during removal, only the upper portion of hooded closure 14 is grasped without grasping any part of the bag 10 itself in so doing.

Figure 4:
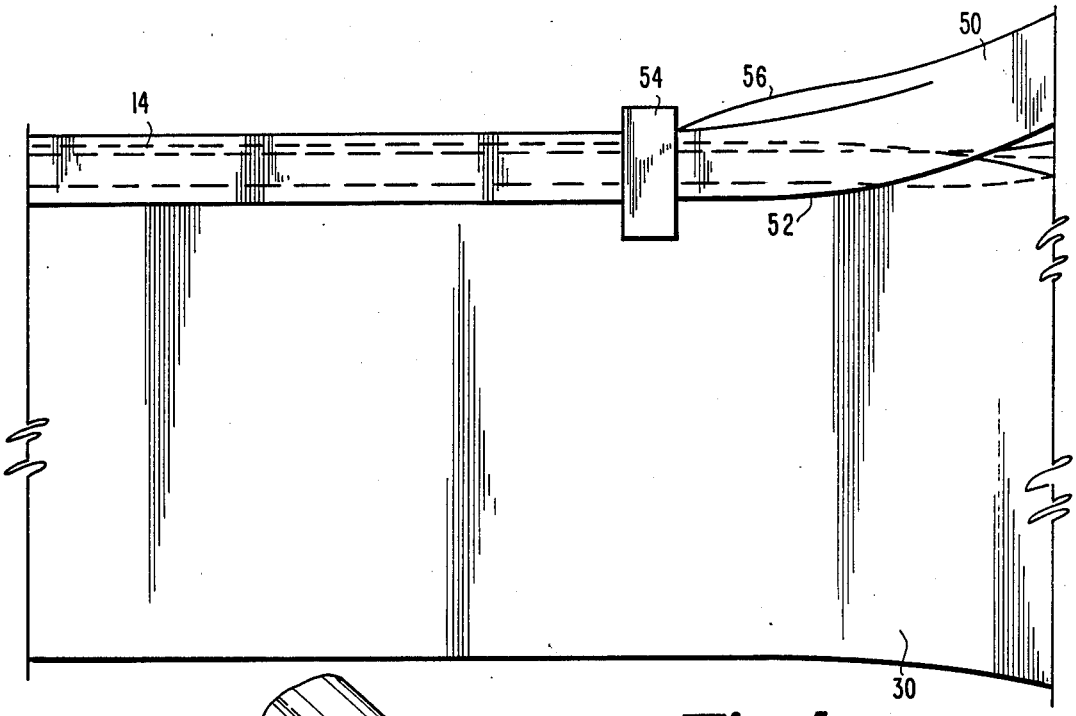
FIG. 4 is a fragmentary detail view of the method of FIG. 3 showing the folding method of the hooded closure embodying the present invention.
Figure 5:
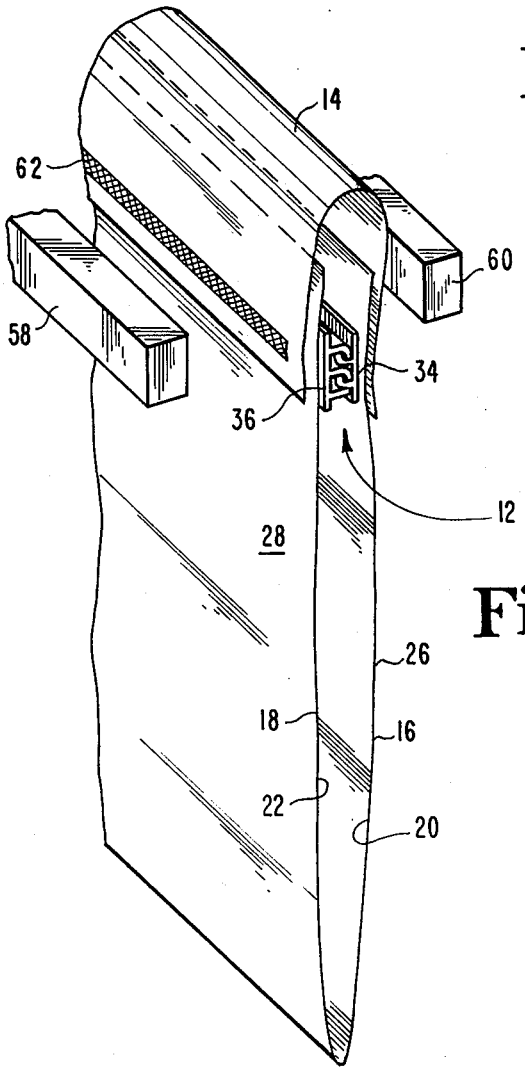
FIG. 5 is a fragmentary sectional view showing the upper portion of the bag embodying the present invention.

The present invention also contemplates a method by which said tamper evident recloseable bags 10 can be constructed. FIG. 3 illustrates in schematic form two continuous webs 30 and 32 of plastic film, oppositely disposed in a flattened position, one upper web 30 and one lower web 32, being advanced and which will form bag wall panels 16 and 18. A continuous roll 48 of male and female fastener profile elements 34 and 36 are engaged and are advanced along with the two continuous webs of film 30 and 32. Additionally, a continuous web of plastic film 50 which will form the hooded closure 14 is illustrated, and is also advanced along with the two continuous webs of film 30 and 32. The engaged fastener profile elements 34 and 36, which make up the recloseable fastener profile assembly 12, are advanced along the inner sides 20 and 22 of the upper portion 24 of the webs of film 30 and 32 respectively, as illustrated in FIGS. 3 and 5. As to the hooded closure 14, one edge 52 of the web of film 50 which will form the hooded closure 14, is advanced along the outer side 26 of the upper portion 24 of the upper web 30. Web 50 is then folded over and around by a folding guide 54, best shown in FIG. 4, in a C-shaped fashion thereby placing the opposite edge 56 of the web 50 along the outer side 26 of the upper portion 24 of the lower web 32, as shown in FIG. 4.

The continuous webs 30, 32 and 50 and engaged fastener profile assembly 12 are advanced simultaneously and in proper alignment for heat sealing the continuous webs 30, 32 and 50 and fastener profile assembly 12 together as illustrated in FIGS. 3 and 5. A heat sealing mechanism 58 and 60 is located on each side of the webs 30 and 32. The webs 30, 32 and 50 and engaged fastener profile assembly 12 are advanced through the heat sealing mechanisms 58 and 60 thereby being fused together along two individual common and continuous lines 62 and 64. Commonly known sealing methods such as impulse sealing or bar sealing may be used. It should be understood that the sealing along lines 62 and 64 not only seals the hooded closure to the wall panels 16 and 18, but also seals the profile assembly 12 to the wall panels 16 and 18.

Figure 6:
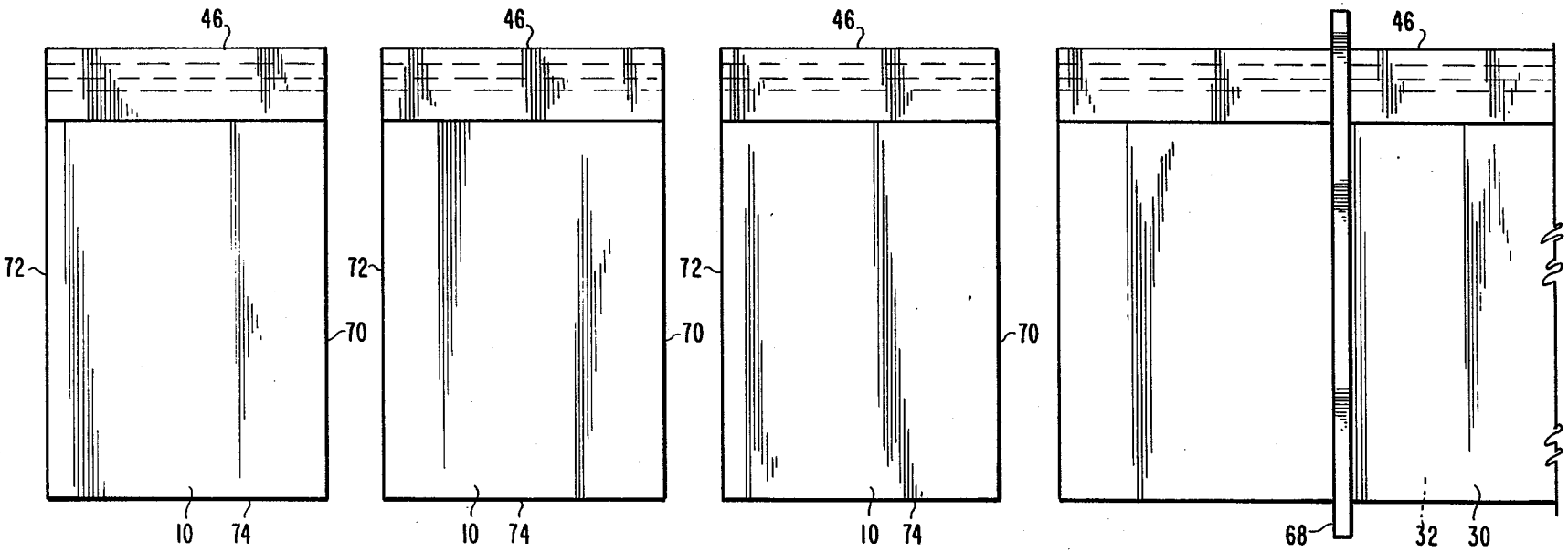
FIG. 6 is a fragmentary side elevational view showing a final stage in making of the bags.

The continuous webs of plastic film 30 and 32 with fastener profile assembly 12 attached to the inner sides 20 and 22 of the upper portion 24, and continuous webs 30 and 32 being joined at the upper portion 24 by the hooded closure 14, are then further advanced through a heat sealing and cutting mechanism 68. This heat sealing and cutting mechanism 68 is positioned perpendicular to the upper portion 24 of the webs 30 and 32. As the webs 30 and 32 pass under the heat sealing and cutting mechanism 68, the webs 30 and 32 are fused together across a continuous line, and are then severed at that same line, thereby creating individual bags 10 with sealed side edges 70 and 72 as shown in FIG. 6. The heat sealing cutting mechanism 68 can be controlled to heat seal and cut at variable intervals thereby having the ability to produce bags 10 of differing sizes.

After the above process is completed, the individual bags 10 having a sealed top edge 46, sealed side edges 70 and 72, and an open bottom portion 74, are accumulated. The open bottom portion 74 is for loading contents into the bag 10, after which time the bottom edge 74 is heat sealed together.

In an alternative method, the tamper evident recloseable bags 10 can be constructed similarly, but with a sealed bottom edge 74 and open top portion 46. In this embodiment, the user will fill the bag with contents through the top portion 46, and then heat seal the hooded closure 14 over the top portion 46 after filling has been completed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tamper evident reclosable bag comprising two opposing plastic wall panels having a tamper evident hooded closure and reclosable separable fastener assembly attached to said wall panels proximate to the top, said assembly comprising:

oppositely disposed first and second cooperating fastener profile elements attached to the inside surfaces of said wall panels arranged in a position facing each other; and said first and second cooperating fastener profile elements being selectively interlockable when pressed together and selectively releasable when pulled apart;

a hooded closure attached at a pair of lower portions thereof to the outside surfaces of said wall panels and having an integral upper portion thereof enveloping said top of said wall panels and preventing said cooperating fastener profile elements from being openable and reclosable prior to removal of said hooded closure;

said hooded closure having a line of perforations extending lengthwise across said hooded closure and situated below the top of said wall panels to effect removal of said hooded closure and allow access to said cooperating fastener profile elements thereby visually indicating the opened condition of said bag;

said upper portion of said hooded closure being adapted for easy removal from said wall panels by pulling said upper portion of said hooded closure above said top of said wall panels in an upward motion, thereby tearing said hooded closure along said line of perforations.

2. A tamper evident recloseable bag according to claim 1 wherein said hooded closure is colored to augment the tamper evident characteristics of said hooded closure.

3. A tamper evident reclosable bag according to claim 1 wherein said fastener profile elements are extruded integral with said wall panels proximate to said top portion.

4. A tamper evident recloseable bag according to claim 1 wherein said wall panels are of one piece and are folded at the bottom edge.

5. A tamper evident reclosable bag according to claim 1 wherein said hooded closure includes a visual mark generally at the center of said upper portion of said hooded closure which indicates the location which the user may grasp during removal of said hooded closure.

6. A tamper evident recloseable bag according to claim 1 wherein said hooded closure is adhesively attached to said outer side of said wall panels.

7. A tamper evident recloseable bag according to claim 1 wherein said hooded closure is of a thinner construction than said bag walls.

8. A tamper evident recloseable bag according to claim 1 wherein said hooded closure is of a heavier construction than said bag walls.

9. A tamper evident reclosable bag according to claim 1 wherein said hooded closure is affixed to said wall panels coincident with said fastener profile elements.

10. A tamper evident reclosable bag according to claim 9 wherein said hooded closure includes a pair of lines of perforations, one each of said pair of lines being proximate to said lower portions of said hooded closure.

11. A tamper evident reclosable bag according to claim 9 wherein said hooded closure and said fastener profile elements are heat sealed to said wall panels.

12. A tamper evident reclosable bag comprising two opposing plastic wall panels having sealed side edges, an open bottom edge, and a sealed openable top portion having a tamper evident hooded closure and separable fastener assembly attached to said wall panels proximate to the top of said wall panels, said sealed openable top portion comprising:

oppositely disposed first and second cooperating fastener profile elements attached to the inside surfaces of said wall panels and arranged in a position facing each other; and said first and second cooperating fastener profile elements being selectively interlockable when pressed together and selectively releasable when pulled apart;

a hooded closure attached at a pair of lower portions thereof to the outside surfaces of said wall panels and having an integral upper portion thereof enveloping said top portion of said wall panels and preventing said cooperating fastener profile elements from being openable and reclosable prior to removal of said hooded closure;

said hooded closure having a line of perforations extending lengthwise across said hooded closure and situated below the top of said wall panels to effect removal of said hooded closure and allowing access to said cooperating fastener profile elements and visually indicating the opened condition of said bag;

said upper portion of said hooded closure being adapted for easy removal from said top portion of said wall panels by pulling said upper portion of said hooded closure above said top of said wall panels in an upward motion thereby tearing said hooded closure along said line of perforations.

13. A tamper evident recloseable bag according to claim 12 wherein loading of said bag with contents is effected through said open bottom edge of said bag and wherein said bottom edge is sealed after said loading.

14. A tamper evident recloseable bag according to claim 12 wherein said first and second profile elements are interlockably engaged prior to loading of contents.

15. A tamper evident reclosable bag comprising two opposing plastic wall panels having sealed side edges, a closed bottom edge and an openable top portion having a tamper evident hooded closure and reclosable separable fastener assembly attached to said wall panels proximate to the top of said wall panels, said openable top portion comprising:

oppositely disposed first and second cooperating fastener profile elements attached to the inside surfaces of said wall panels arranged in a position facing each other; and said first and second cooperating fastener profile elements being selectively interlockable when pressed together and selectively releasable when pulled apart;

a hooded closure attached at a pair of lower portions thereof to the outside surfaces of said wall panels and having an integral upper portion thereof enveloping said top portion of said wall panels and preventing said cooperating fastener profile elements from being openable and reclosable prior to removal of said hooded closure;

said hooded closure having a line of perforations extending lengthwise across said hooded closure and situated below the top of said wall panels to effect removal of said hooded closure and allowing access to said cooperating fastener profile elements thereby visually indicating the opened condition of said bag;

said upper portion of said hooded closure being adapted for easy removal from said top portion of said wall panels by pulling said upper portion of said hooded closure above said top of said wall panels in an upward motion thereby tearing said hooded closure along said line of perforation.

16. A tamper evident recloseable bag according to claim 15 wherein filling of contents is effected through said openable top portion of said bag and wherein said hooded closure is attached subsequent to said loading.

* * * * *